US005127198A

United States Patent [19]

Nakayama et al.

[11] Patent Number: 5,127,198

[45] Date of Patent: Jul. 7, 1992

[54] METHOD TO PROCESS A STEERING WHEEL AND A PROCESSING DEVICE OF A STEERING WHEEL

[76] Inventors: Akinori Nakayama, Nippon Sangyo Kikai Hanbai Co., Ltd., 1116-50, Takata, Kashiwa-shi, Chiba; Mitsuya Kurachi, Showa Tansan Co., Ltd., 3-23, Misakicho 3-chome, Chiyoda-ku, Tokyo; Kiyoshi Sudo, Showa Tansan Co., Ltd., 3-25, Misakicho 3-chome, Chiyoda-ku, Tokyo; Toshiharu Kamijo, Showa Tansan Co., Ltd., 3-23, Misakicho 3-chome, Chiyoda-ku, Tokyo, all of Japan

[21] Appl. No.: 690,401

[22] Filed: Apr. 23, 1991

Related U.S. Application Data

[62] Division of Ser. No. 488,574, Mar. 2, 1990, Pat. No. 5,029,419.

[30] Foreign Application Priority Data

May 22, 1989 [JP] Japan ..... 1-128027

[51] Int. Cl.[5] ..... B24C 3/08

[52] U.S. Cl. ..... 51/410; 51/419; 51/424; 51/5 R; 51/322

[58] Field of Search ..... 51/419, 421, 420, 322, 51/410, 5 R, 165.73, 322, 424, 425

[56] References Cited

U.S. PATENT DOCUMENTS 4,312,156 1/1982 McWhorter ..... 51/322 X
4,633,928 1/1987 Uzaki et al. ..... 164/19
4,917,708 4/1990 Yamaguchi et al. ..... 51/419

*Primary Examiner*—M. Rachuba

[57] ABSTRACT

A soft synthetic resin, such as polyurethane, body is molded onto a metallic steering wheel frame except for a part thereof intended for installation of the steering wheel onto a column shaft and a soft burr formed on the resultant covered steering wheel along the parting line of the mold is removed by refrigerating the steering wheel to make the burr hard and fragile and then removing the burr by shot blast treatment, whereafter the steering wheel is heat dried to eliminate water from the atmosphere condensing on the exposed metallic installation part of the steering wheel and prevent resulting corrosion of that part.

1 Claim, 13 Drawing Sheets

METHOD TO PROCESS A STEERING WHEEL AND A PROCESSING DEVICE OF A STEERING WHEEL

This is a division of application Ser. No. 07/488,547, filed Mar. 2, 1990 now U.S. Pat. No. 5,029,419.

BACKGROUND OF THE INVENTION

This invention relates to a method and a device for processing a steering wheel to remove burr from a synthetic resin cover body of the steering wheel after the cover body has been formed on a metallic steering wheel frame by using a metallic mold.

Up to now, burr has been generated at the cover body during the formation process of the cover body due to a parting line of a metallic mold by means of which a cover body made of synthetic resin material is formed on a steering wheel frame except a part thereof for connecting the steering wheel with a column shaft.

For this reason, work to remove burr was necessary after the forming process. However, the removal of burr had to be done only by handwork using cutting knives since the cover body is made of relatively soft synthetic resin material such as polyurethane. This was relatively costly and inefficient. Furthermore, different finishes were obtained according to the skill of the workers and uniform finishes would not be obtained whereby some steering wheels would be rejected due to mistakes of workers.

SUMMARY OF THE INVENTION

The principal object of this invention is to provide a method of processing steering wheels that is able to remove burr efficiently and provide uniform finish, and to protect from corrosion an exposed part of the frame of the steering wheel connecting with a column shaft, and to process a steering wheel at low cost.

The above and further objects and novel features of the invention will more fully appear from the following detailed description when the same is read in connection with the accompanying drawings. It is to be expressly understood, however that the drawings are for purpose of illustration only and are not intended as a definition of the limits of this invention.

DESCRIPTION OF PREFERRED EMBODIMENTS

This invention will be described in detail hereinafter with reference to the embodiments shown in the figures.

Figure 1:
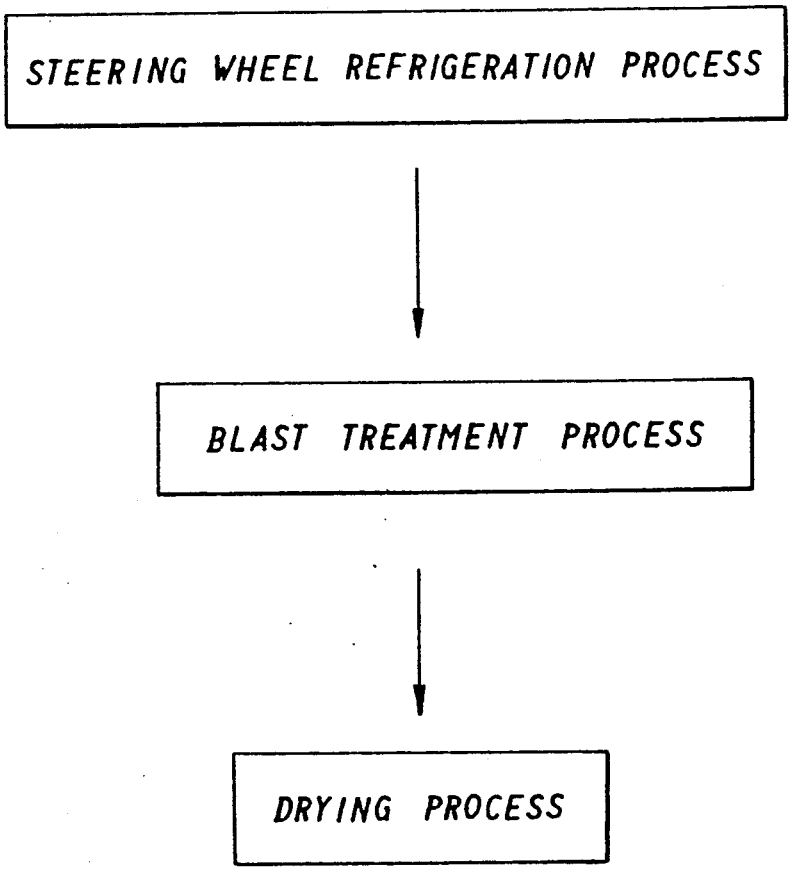
FIG. 1 is a flow chart showing an embodiment of a method to process a steering wheel of this invention.
Figure 2:
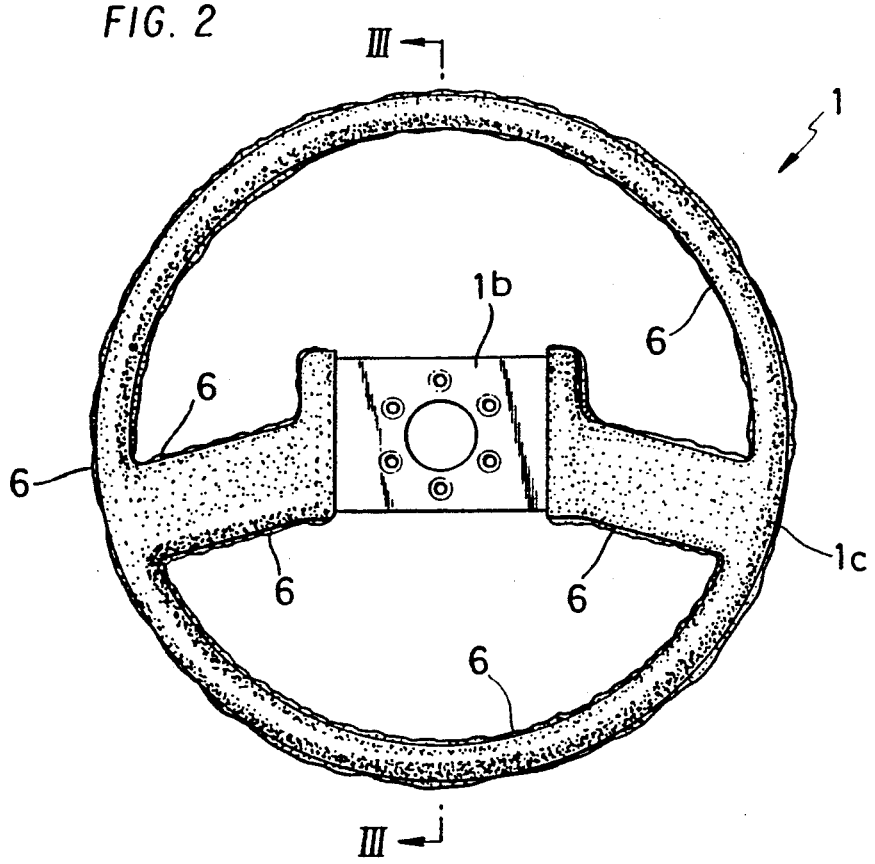
FIG. 2 is a plan view of a steering wheel to be processed.
Figure 3:
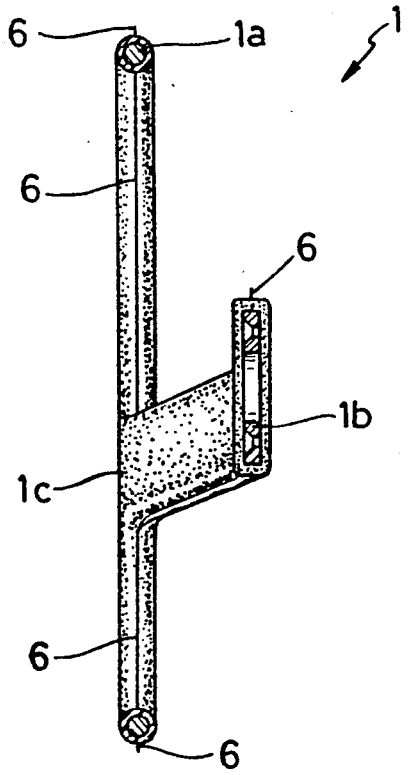
FIG. 3 is a cross-sectional view taken on line 3—3 of FIG. 2.
Figure 4:
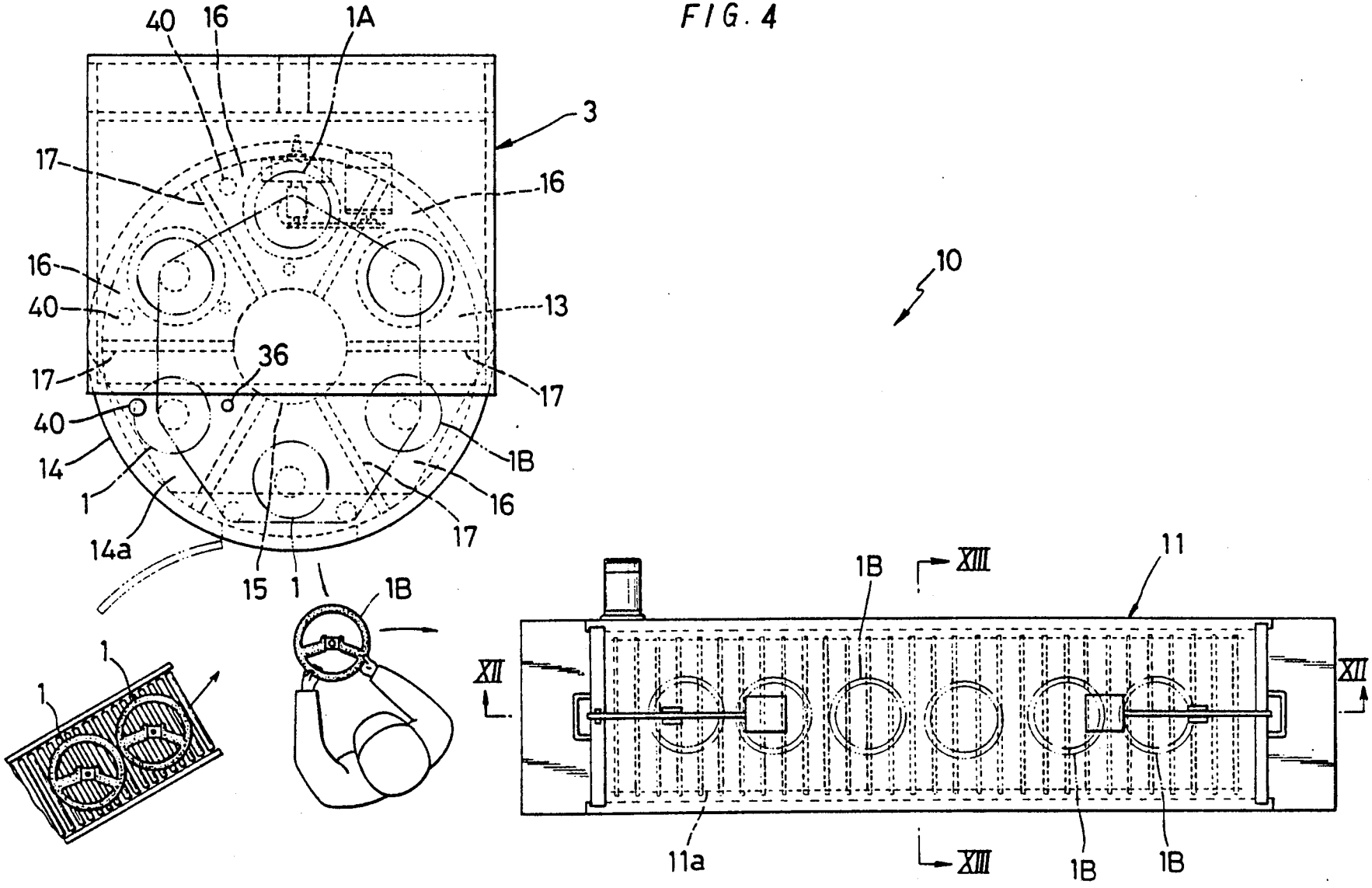
FIG. 4 is a plan view of an embodiment of a processing device of a steering wheel of this invention.
Figure 5:
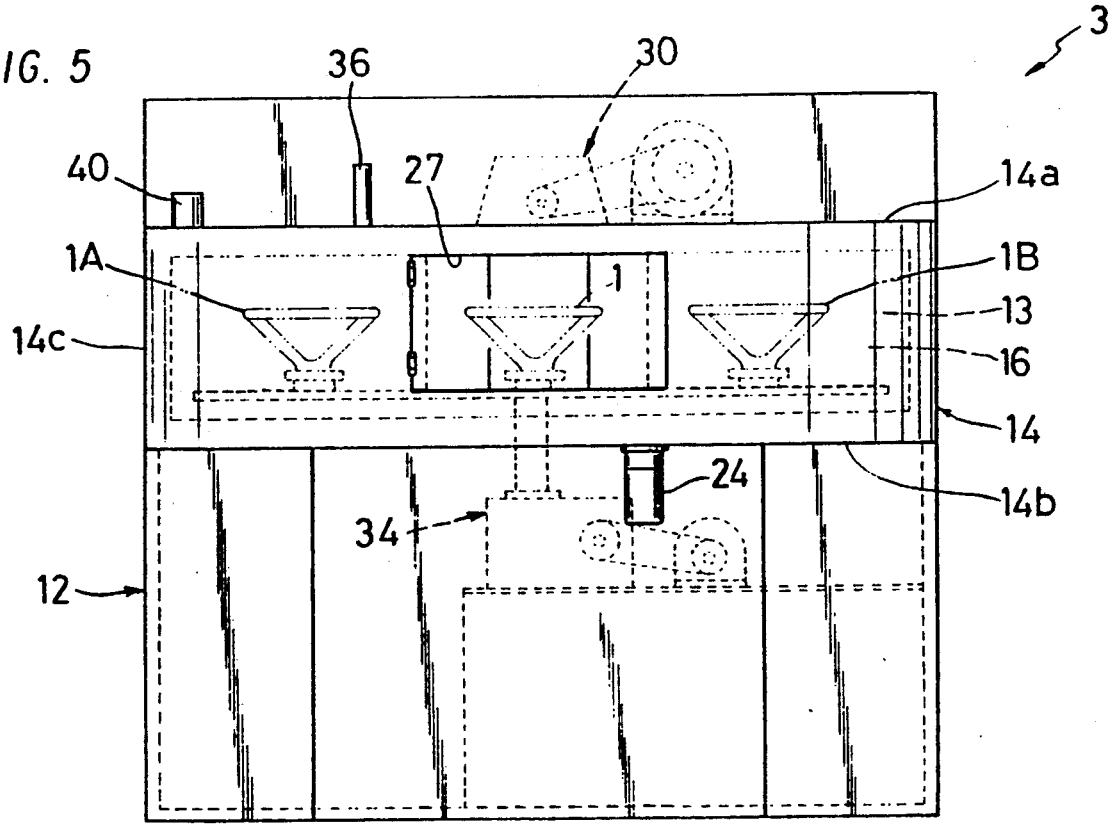
FIG. 5 and FIG. 6 are front and side views, respectively, showing a shot blast apparatus which is used in the processing device of a steering wheel of this invention.
Figure 6:
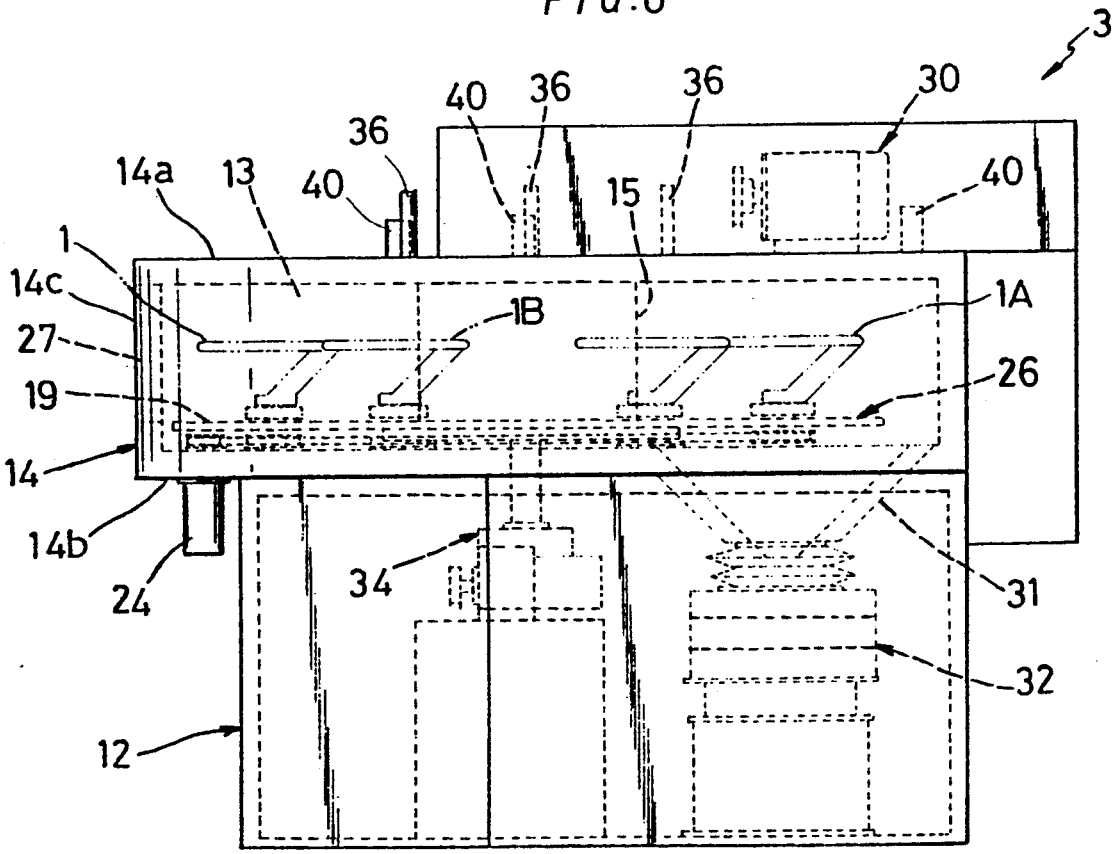
Figure 7:
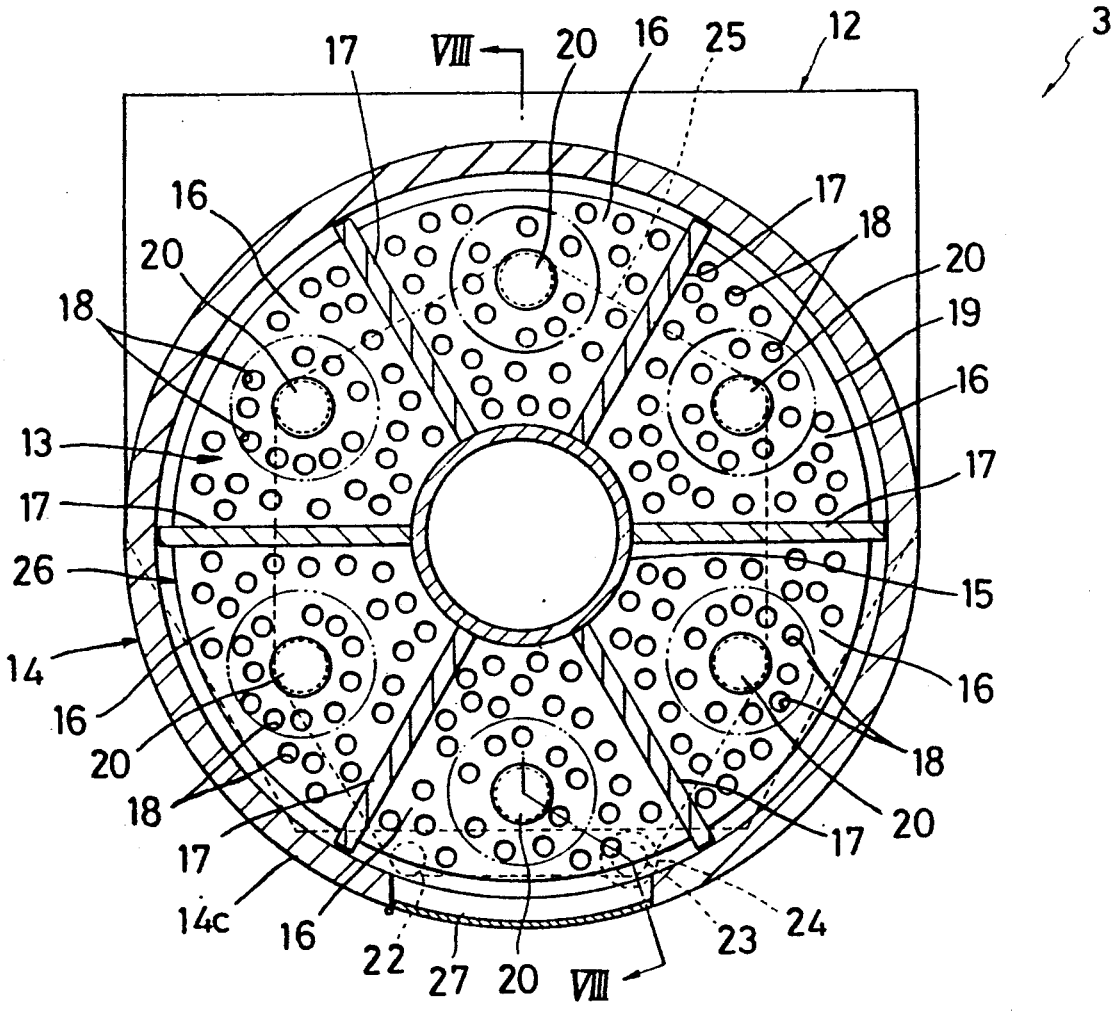
FIGS. 7 to 9 inclusive are explanatory views of a rotating apparatus for a supporting stand for a shot blast apparatus shown in FIG. 5 and FIG. 6.
Figure 8:
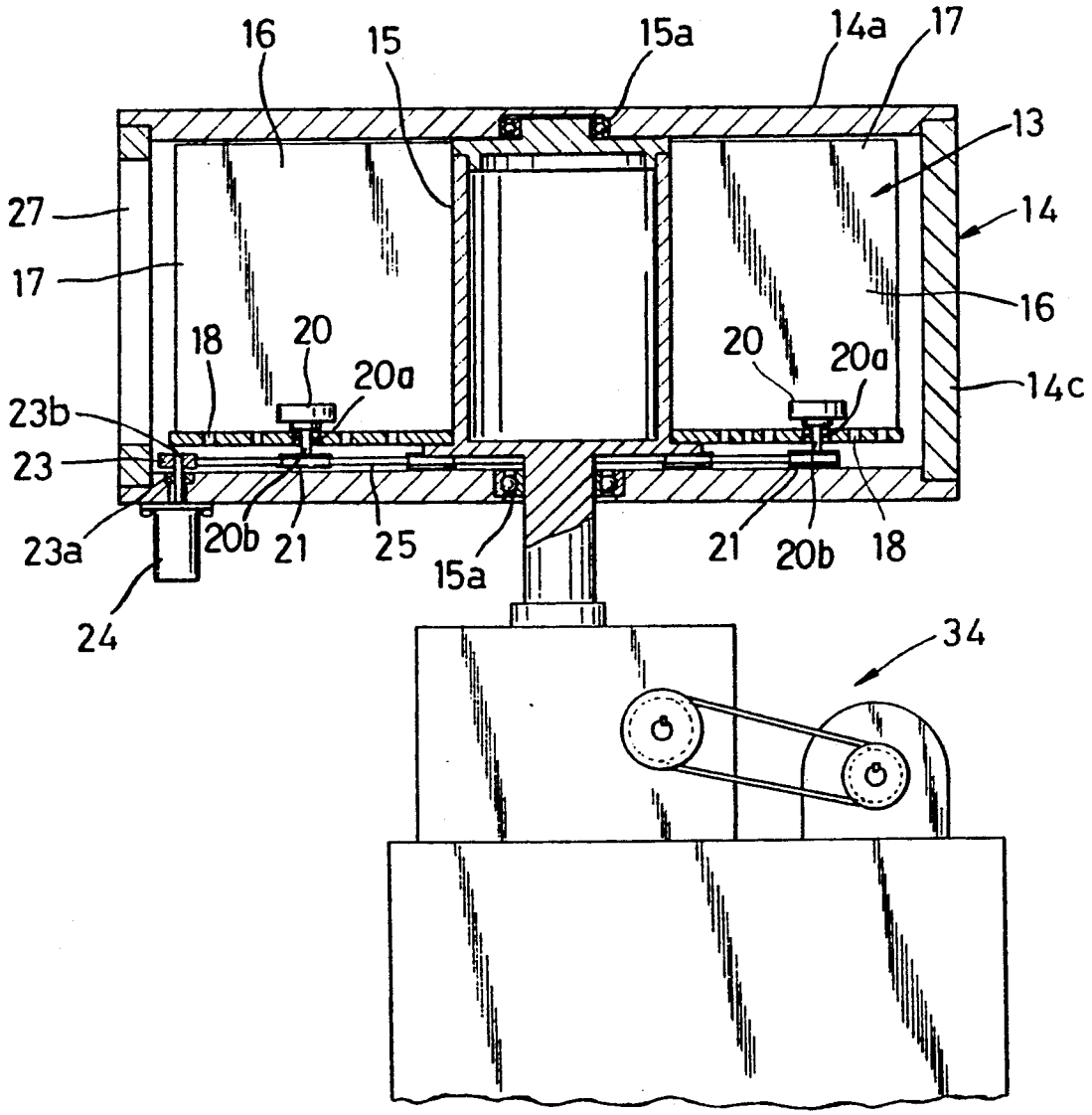
Figure 9:
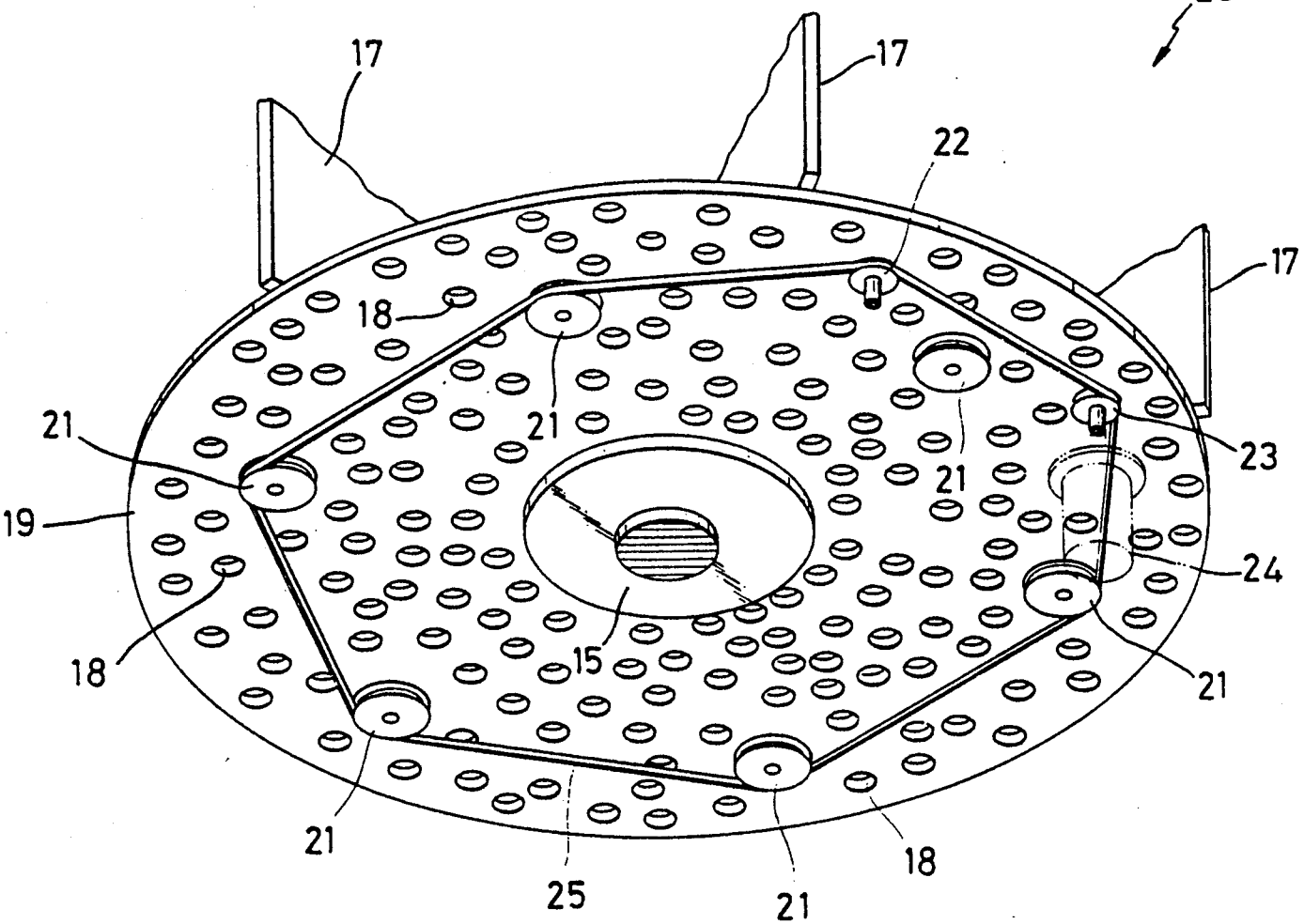

A steering wheel 1 shown in FIG. 2, which is used in a method of processing the steering wheel of this invention, comprises a steering wheel frame 1*a* made of metallic material and a cover body 1*c* which is formed from synthetic resin material such as polyurethane using a metallic mold so that the cover body 1*c* covers all of the steering wheel frame except the part 1*b*, as shown in FIG. 2 and FIG. 3, for installing the steering wheel onto a column shaft.

Burr 6 is generated along the parting line of the metallic mold during the forming process of the cover body 1*c*.

The steering wheel 1 having burr 6 is processed into a steering wheel 1B from which burr has been removed by the steering wheel processing method of this invention.

The steering wheel processing method comprises three processes. These are: (1) refrigerating process in which the steering wheel 1 having burr 6 is refrigerated to 0° C. to −100° C., more preferably −40° C. to −60° C., (2) blast treatment process in which burr 6 is removed from the cover body 1*c* by projecting grinding lubricant onto the steering wheel 1 to result in burr-free steering wheel 1B and (3) drying process in which the steering wheel 1B is dried.

In the above mentioned process for refrigerating a steering wheel, refrigeration to 0° C. to −100° C. is effected by introducing liquified inert gas such as liquid nitrogen into a processing chamber.

The above mentioned blast treatment process is effected by projecting a grinding lubricant onto a steering wheel in a refrigerated processing chamber by using a projection machine. Grinding lubricant is non-ferrous and appropriate particle size or the quality of the grinding lubricant is chosen according to the quality of the material which composes the cover body 1*c*.

In this blast treatment process, the refrigerated steering wheel can be rotated while grinding lubricant is projected onto the steering wheel in order to remove burr effectively.

The above mentioned drying process is carried out to avoid the condensation of water on the steering wheel. If the refrigerated steering wheel, from which burr has been removed during the blast treatment process, is allowed to sit in the air, water condenses on the exposed part of the steering wheel by means of which the steering wheel is to be installed onto a column shaft and causes corrosion in this part.

The above mentioned method of processing a steering wheel is carried out by using steering wheel processing installation 10. This processing installation 10, as shown in FIGS. 4–11 inclusive, comprises a shot blast apparatus 3 which can refrigerate and then blast treat the steering wheel 1 and a drying apparatus 11, such as high frequency induction heating apparatus, which heat dries the steering wheel 1B previously treated with the shot blast apparatus 3 and moving on a belt-conveyor system 11*a*.

The above mentioned shot blast apparatus 3 comprises the following as indicated in FIGS. 4–11 inclusive:

(1) a frame 12 made of stainless steel which is formed to define the perimeter;

(2) a casing 14, made of stainless steel, which is fixed on the frame 12 and the inside of which includes a cylindrical treatment chamber 13;

(3) a rotary shaft 15, made of stainless steel, which is installed rotatably in the top 14*a* and bottom 14*b* walls of the casing 14 through respective bearings 15*a* so as to be located in the center of the treatment chamber 13;

(4) plural partition walls which are fixed on the rotary shaft 15 by means of welding or the like and divide the treatment chamber into a plurality of compartments. Each compartment can hold one steering wheel 1. In this embodiment, six partition walls 17 divide the treatment chamber into six compartments 16;

(5) a disk-shaped supporting plate 19, made of stainless steel, which has a number of holes 18 and is fixed to the lower part of the partition walls 17 by means of welding or the like so that this plate can cover the lower part of the partition walls 17;

(6) a rotating apparatus 26 for steering wheel supporting stands 20 which comprises six steering wheel supporting stands 20 which rotatably support steering wheels 1 in approximately the center of the respective treatment compartments 16 by means of respective bearings 20*a* and respective pulleys 21 which are attached to respective shafts 20*b* attached to respective supporting stands 20, a driving pulley 23 fixed to a shaft 23*b* which is installed rotatably in the lower wall 14*b* of the frontal part of the casing 14 through the bearing 23*a*, a similarly located and installed guide pulley 22, and a motor 24 which drives the shaft 23*b*, and a belt 25 which transmits rotation of the driving pulley 23 to the pulleys 21, and the guide pulley 22;

(7) a door and door opening 27 which is formed in the side wall 14*c* at the front part of the casing 14 and opens a single processing compartment 16;

(8) a refrigerant supplying apparatus 28 installed on the upper wall 14*a* of the casing 14 and which supplies refrigerant inert gas such as liquid nitrogen, liquid carbon dioxide and the like to the second, third and fourth processing compartments 16, if the processing compartment 16 which communicates with the opening 27 is denominated the first processing compartment 16;

(9) a projection machine 30 which is installed on the upper wall 14*a* of the casing 14 at the position corresponding to the fourth processing compartment 16 and projects grinding lubricant to the inside of the processing compartment 16 from an opening;

(10) a hopper 31, which lets grinding lubricant fall to the inside of the frame 12, formed at the lower wall 14*b* of the casing 14 and located at the position corresponding to the processing compartment into which grinding lubricant is projected by the projection machine 30;

(11) a separating machine 32 which is installed in the frame 12 and separates from each other grinding lubricant and dust such as burr and the like dropping from the hopper 31;

(12) a grinding lubricant supplying apparatus 33 which supplies grinding lubricant separated by the separation machine 32 to the projection machine 30;

(13) a rotary shaft driving gear 34 which rotates the rotary shaft 15 intermittently or at a fixed low speed.

Figure 10:
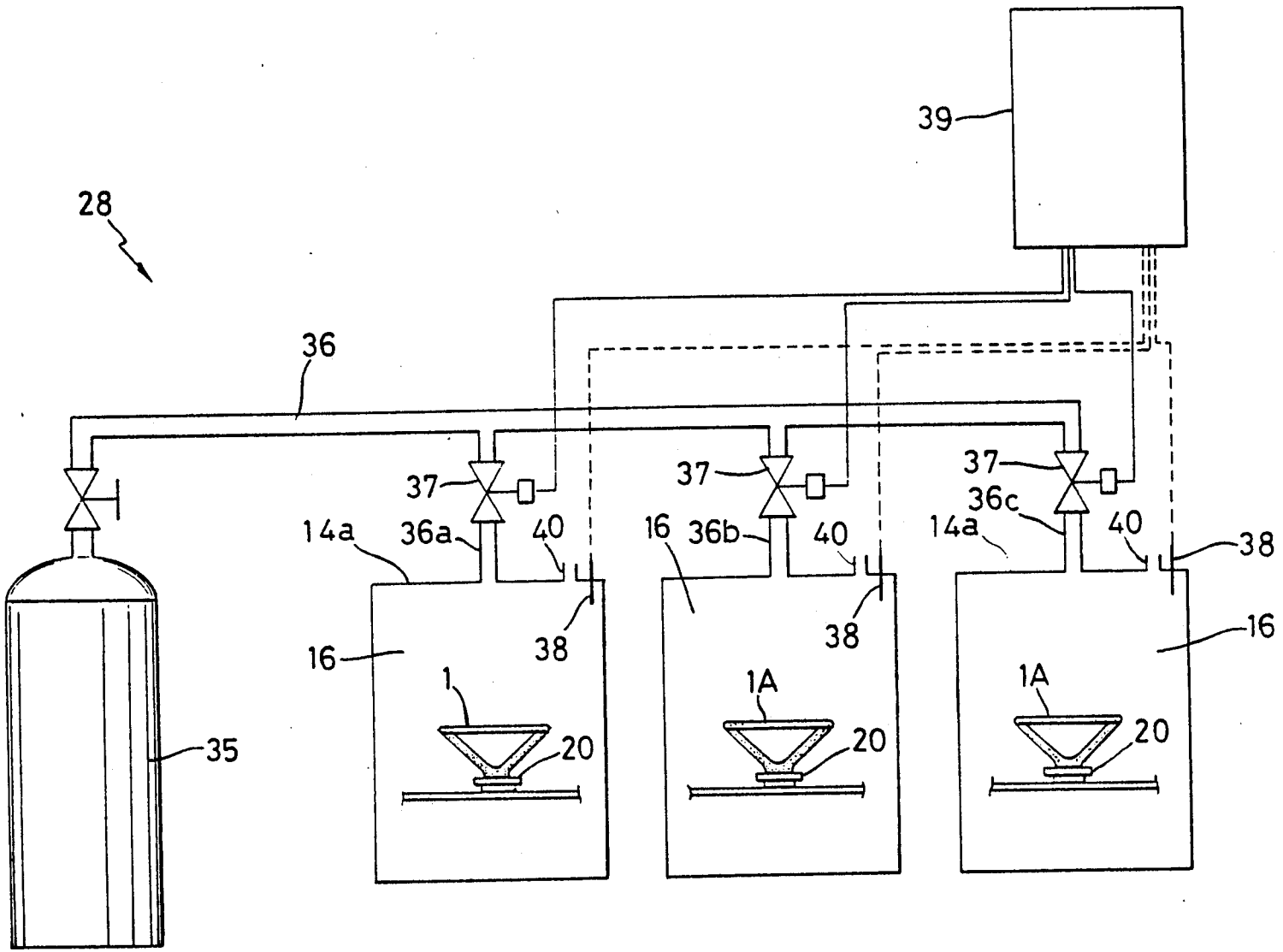
FIG. 10 is an explanatory view of a refrigerant supplying machine of a shot blast apparatus shown in FIG. 5 and FIG. 6.

The above mentioned refrigerant supplying machine 28, as shown in FIG. 10, comprises a refrigerant tank 35, a supplying pipe 36 which supplies refrigerant stocked in the refrigerant tank 35 to the second to fourth processing compartments 16, respective magnetic valves 37 installed in respective supplying conduits 36*a*, 36*b*, 36*c* connecting the supplying pipe 36 to the respective second to fourth processing compartments 16, respective temperature sensors 38, installed in the second to fourth processing compartments 16, a controller 39 which opens and shuts the magnetic valves 37, respectively, according to signals generated by the respective temperature sensors 38, and respective exhaust pipes 40, which exhaust to the outside evaporated refrigerant gas from inside of the respective second to fourth processing compartments 16, the exhaust pipes 4 being located at the upper wall 14*a* of the casing 14.

Figure 11:
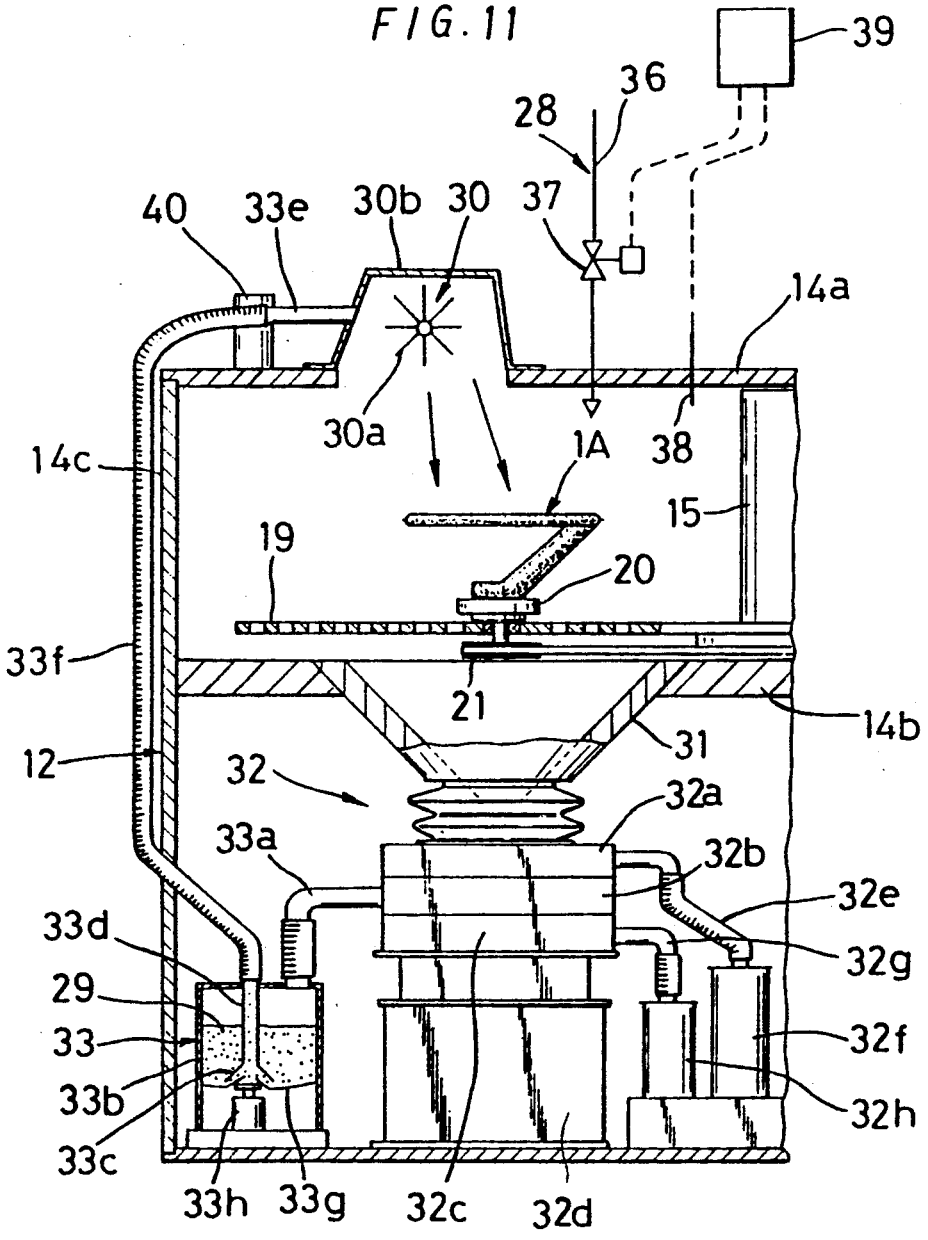
FIG. 11 is an explanatory view of a main part of a shot blast apparatus shown in FIG. 5 and FIG. 6.

The above mentioned separating machine 32, as shown in FIG. 11, comprises a coarse vibrating screen 32*a* for burr separation which receives grinding lubricant and dust such as burr and the like that drops from the hopper 31 and separates burr larger than grinding lubricant, a vibrating screen 32*b* for grinding lubricant separation which separates grinding lubricant from the material dropping from the coarse vibrating screen 32*a*, a container 32*c* which stocks fine dust such as burr dropping from the screen 32*b*, a vibrator 32*d* which vibrates the container 32*c* as well as the vibrating screens 32*b* and 32*a*, a tank 32*f* which receives through a pipe 32*e* large burr separated by the coarse vibrating screen 32*a*, and a dust tank 32*h* which receives dust such as small burr and the like from the container 32*c* through a pipe 32*g*.

The above mentioned grinding lubricant supplying machine 33, as shown in FIG. 11, comprises a tank 33*b* for the grinding lubricant which is supplied with grinding lubricant 29 separated by the vibrating screen 32*b* through a pipe 33*a*, an aspirating pipe 33*d* of which the conical opening 33*c* is located inside of the grinding lubricant tank 33*b* and the extremity connecting part is located outside of the tank 33*b*, a grinding lubricant transporting pipe 33*f* of which the one end is connected to the aspirating pipe 33*d* and the other end to an introducing pipe 33*e* installed in the aspiratory side of the projection machine 30, a damper 33*g* which opens and shuts the opening 33*c* of the aspirating pipe 33*d* installed within the grinding lubricant tank 33*b*, and a magnetic solenoid 33*h* which opens and shuts the damper 33*g*. Grinding lubricant 29 stocked in the grinding lubricant tank 33*b* is aspirated, by rotating an impeller 30*a* driven by the projection machine 30, through the aspirating pipe 33*d*, grinding lubricant transporting pipe 33*d* and introducing pipe 33*e*, and is projected against the steering wheel 1A by the impeller 30*a* of the projection machine 30.

Projection of grinding lubricant is readily stopped by shutting the opening 33*c* of the aspirating pipe 33*f* by operating the damper 33*g* by means of the magnetic solenoid 33*h*.

Figure 12:
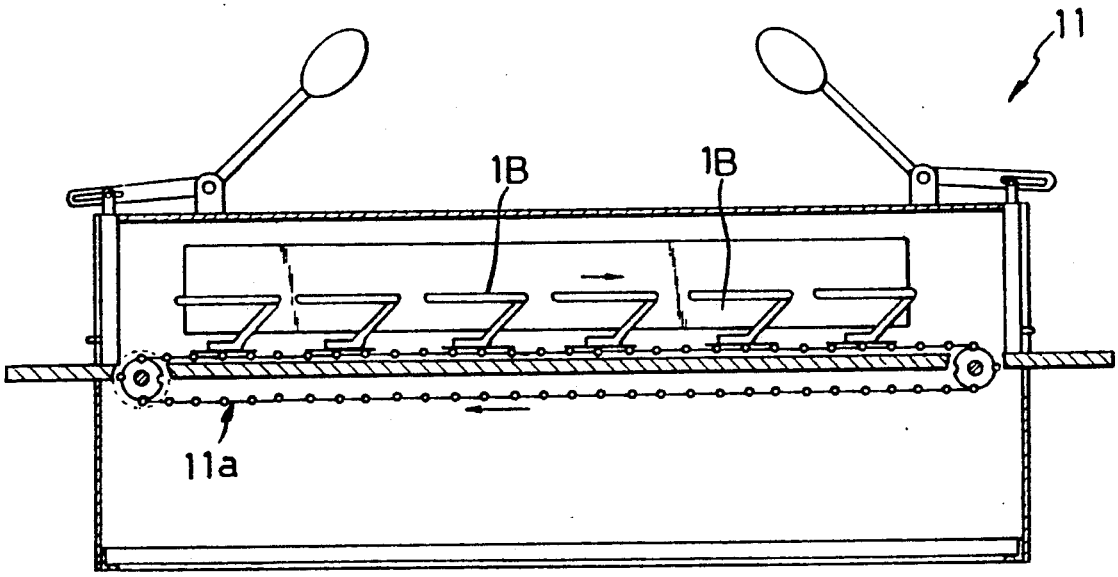
FIG. 12 and FIG. 13 are cross-sectional views showing different embodiments of a drying apparatus which is used in processing of steering wheels.
Figure 13:
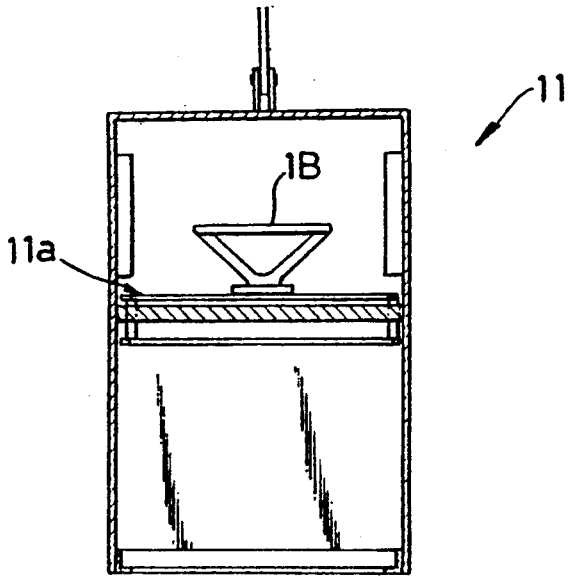

The above mentioned drying apparatus 11, as shown in FIG. 12 and FIG. 13, is equipped with a belt conveyor 11*a* which carries a steering wheel 1B on to the inside of the tunnel-shaped casing 11*b* and with a high frequency induction heating apparatus 11*c* at both sides of the casing 11*b*.

The drying apparatus 11 heat dries the steering wheels 1B so that the dried steering wheels are at room temperature.

The shot blast apparatus 3 starts the steering wheel supporting stand rotating apparatus 26, the refrigerant supplying apparatus 28, the projection machine and the rotary shaft driving ear 34.

Consequently, the steering wheel supporting stand 20 supports and rotates steering wheels 1 which are placed thereon through the opening 27 of the casing 14.

As each processed steering wheel 1B is carried by the supporting stand 20 to the opening 27, it is removed from the processing compartment 16 and an unprocessed steering wheel 1 is placed through the opening 27 on the area of the supporting stand 20 formerly occupied by the just removed processed steering wheel 1B.

The processing compartment 16, where the steering wheel 1 to be processed is supported, rotates and moves to become the second, third, fourth, fifth and sixth compartments in that order by the drive of the rotary shaft driving gear 34.

The steering wheels 1 are progressively refrigerated to the desired temperature by the refrigerant supplying apparatus 28 which refrigerates the second, third and fourth processing compartments by the rotation of the compartments to the positions corresponding to the second, third and fourth compartments.

At the position corresponding to the fourth compartment, grinding lubricant is projected from the projection machine 30 and burr of the cover body 1*c* of the refrigerated steering wheel 1A is removed.

After that, these compartments rotate to the positions corresponding to the fifth and sixth compartments and the first compartment having the opening 27.

The steering wheels 1, 1A, 1B, which are supported by each steering wheel supporting stand 20, are rotated by the rotating apparatus 26.

The blast treatment can be done efficiently by refrigeration and the projection machine 30.

As the steering wheel 1B processed by the shot blast apparatus 3, is in the frozen state, it is supplied by hand or by robots to the drying apparatus 11 and dried so that corrosion is not generated by condensation of atmospheric moisture onto exposed metallic parts of the steering wheels 1B even when the steering wheels 1B are left in the air.

Grinding lubricant projected by the projection machine 30 circulates as follows: projection machine 30→processing compartment 16→hopper 31→separating machine 32→grinding lubricant supplying apparatus 33→projection machine 30. This enables more efficient utilization of grinding lubricant and since grinding lubricant is refrigerated when it passes through the processing compartment 16 or the hopper 31 and is projected in the frozen state, the blast effect is increased.

Further, to keep the circulation path of grinding lubricant cool, the peripheries of the casing 30*b* of the projection machine 30, the hopper 31, separating machine 32 and the grinding lubricant supplying apparatus 33 are covered with insulating material, which enables keeping the grinding lubricant frozen and avoiding the aggregation of grinding lubricant thereby allowing its efficient flow.

Now, other embodiments of this invention, shown in FIGS. 14–17 inclusive, will be discussed. Further, in the description of these embodiments, duplicate description for the components which are identical in the various embodiments of this invention will be omitted by giving identical symbols to identical components.

Figure 14:
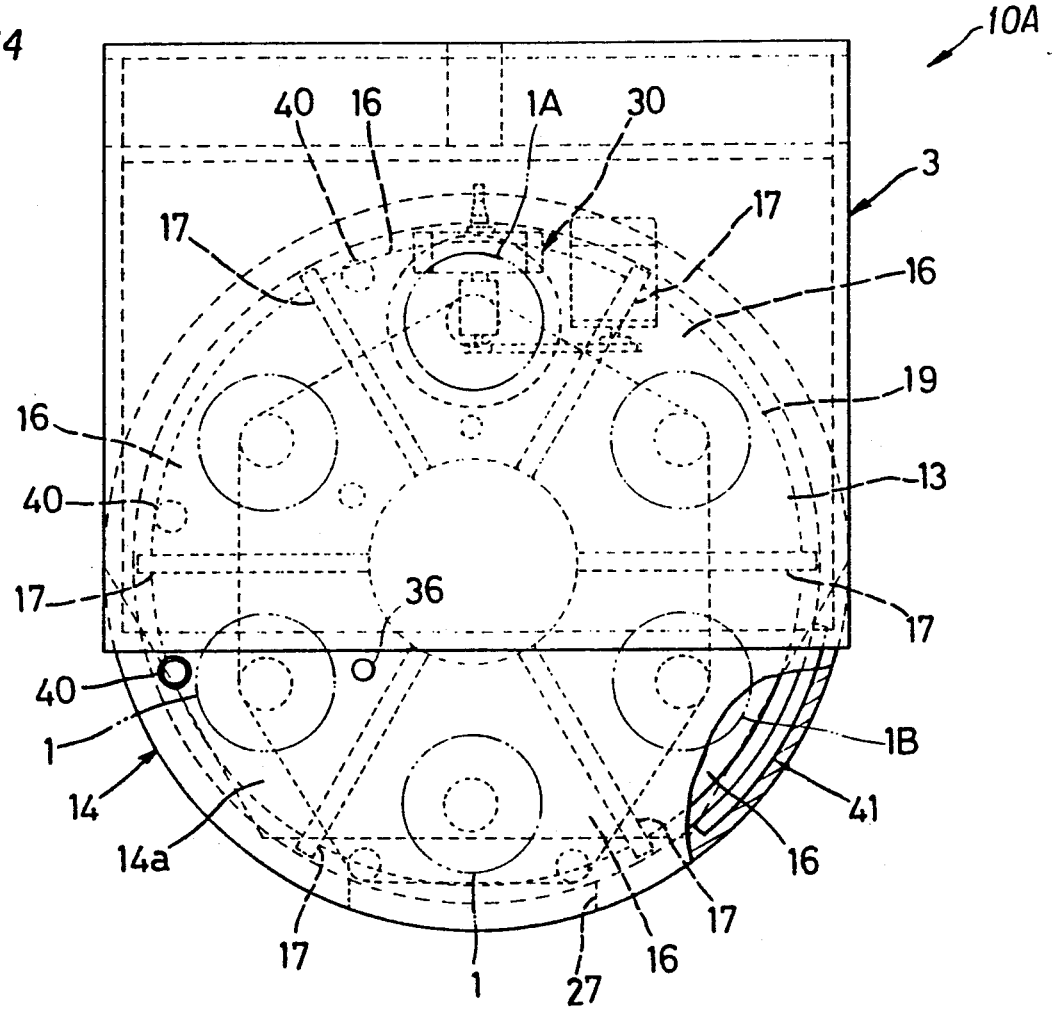
FIG. 14 and FIG. 15, FIG. 16 and FIG. 17, are explanatory views showing different embodiments of a shot blast device of this invention, respectively.
Figure 15:
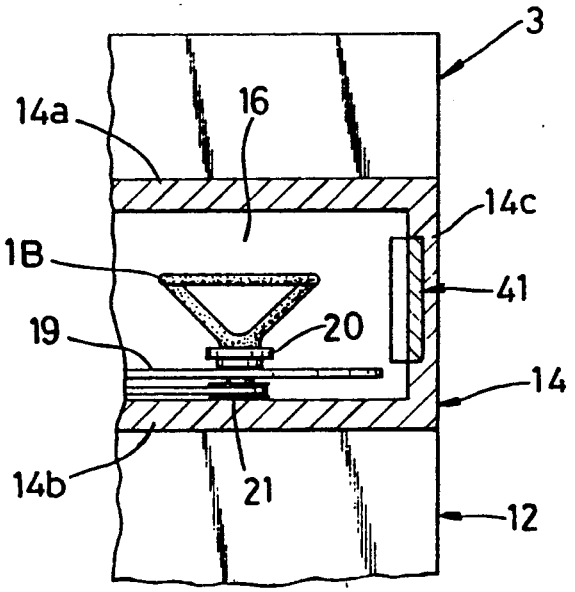

In the processing installation 10A shown in FIG. 14 and FIG. 15, the significant difference is that a high frequency induction heat drying apparatus 41 which heat dries the blast treated steering wheel 1B is provided so that the inside of the sixth processing compartment located upstream of the opening 27 of the casing 14 can be heated.

It will be appreciated that it is possible to obtain the identical effect with the processing installation 10A as with the processing installation 10.

The processing installation 10A is suitable for the processing of the steering wheel of which the cover body is made of synthetic resin material treatable at relatively higher temperature of refrigeration, for example 0° C. to −10° c.

Figure 16:
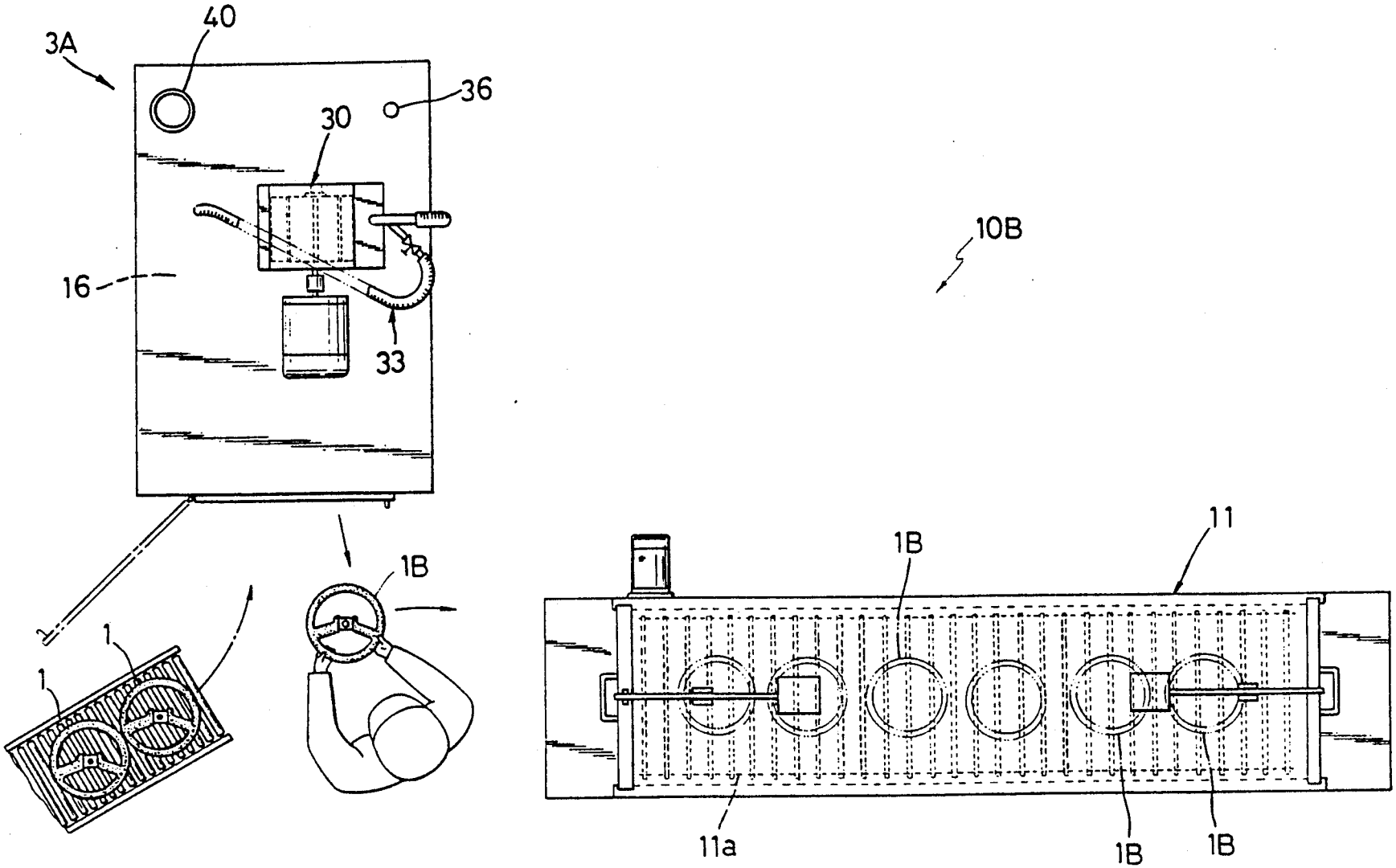
Figure 17:
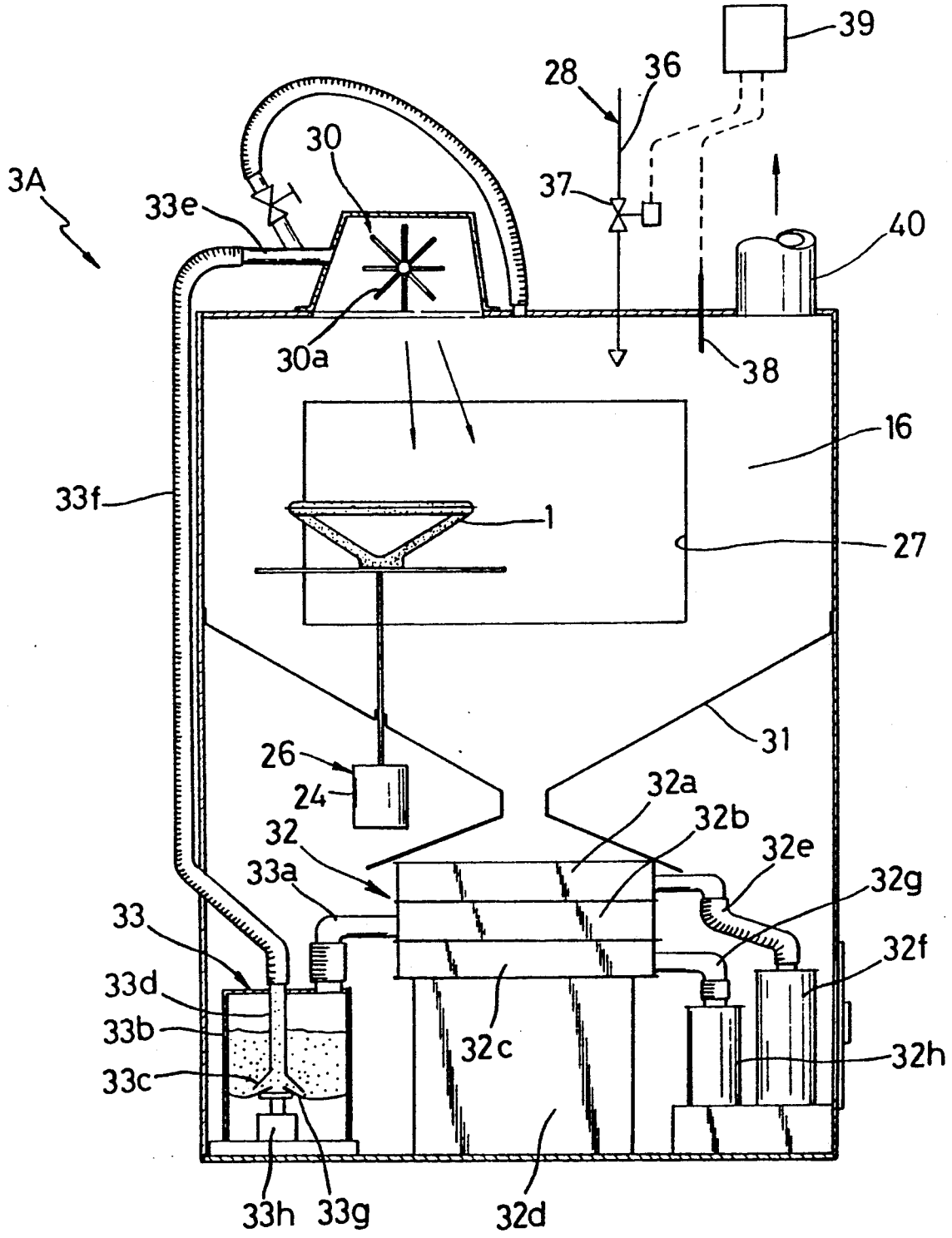

In the processing installation shown in FIG. 16 and FIG. 17, the significant difference is that a shot blast apparatus 3A, which refrigerates the steering wheel 1 by supplying refrigerant into a processing compartment 16 after the steering wheel 1 is introduced into that processing compartment 16, as provided.

After that, the blast treatment is done by projecting grinding lubricant against the steering wheel 1A by the projection machine 30, and the blast-treated steering wheel 1B is taken out of the processing compartment 16 and is supplied to the drying apparatus by hand or by robots.

It will be appreciated that it is possible to obtain an identical effect with the processing installation 10B as with the processing installation 10.

What is claimed is:

1. An apparatus for deburring a plurality of steering wheels, each of the steering wheels having soft polyurethane external portions on which burr has been formed along lines corresponding to parting lines of a mold by which said portions were molded, and each of the steering wheels also having external portions consisting of a metal subject to corrosion upon contact with water, the apparatus comprising a frame, a casing having a cylindrical side wall and in which a cylindrical treatment chamber is formed and which is fixed to an upper part of the frame, a rotary shaft received in the treatment chamber coaxially therewith, the shaft being rotatable relative to the frame, means for rotating the shaft in a predetermined direction, a circular plate fixed to the shaft coaxially therewith, the plate defining the floor of the chamber and having a plurality of holes therethrough throughout the entire area thereof, a plurality of radial partition walls fixed to the shaft and dividing the chamber into a plurality of processing compartments of equal size each for receiving one steering wheel, an opening formed through the side wall of the casing and being sized to register and thereby communicate with any one of said compartments, a door for the opening, a respective stand mounted in each of said compartments for holding a steering wheel with the axis thereof parallel to the axis of the chamber, means for rotating each of said stands and therewith each of said steering wheels, means for supplying refrigerant to a mutually adjacent plurality of said compartments thereby to refrigerate said compartments when said compartments are angularly displaced from said opening by an angular distance corresponding to at least one compartment, means for supplying refrigerated grinding lubricant to one of said refrigerated compartments, said one refrigerated compartment being the last refrigerated compartment from said opening in said predetermined direction of rotation, means for projecting said refrigerated grinding lubricant into said one refrigerated compartment so that it contacts the steering wheel in said one refrigerated compartment and deburrs it, a hopper below the floor of said one compartment, the hopper being positioned to receive and collect grinding lubricant and polyurethane debris from the deburring which pass through the holes in the floor of said one compartment and into said hopper, means communicating with said hopper for separating the collected refrigerated grinding lubricant from the debris and returning the collected refrigerated grinding lubricant to the means for supplying refrigerated grinding lubricant, the means for projecting being enclosed in a thermally insulating housing and the hopper, the separating machine and the grinding lubricant supplying means all being thermally insulated so that the grinding lubricant, after being refrigerated by its passing through said one compartment, remains refrigerated, and means for subjecting the deburred steering wheel to high frequency induction heating for heating and thereby evaporating any atmospheric moisture condensed on the external metal portions of the steering wheel without heating the steering wheel.

* * * * *